US006880581B1

(12) United States Patent
Weeks

(10) Patent No.: US 6,880,581 B1
(45) Date of Patent: Apr. 19, 2005

(54) METHOD OF FORMING A TUBE

(75) Inventor: Kevin William Weeks, Glandore (AU)

(73) Assignee: Weeks Peacock Quality Homes Pty Ltd., Glandore (AU)

( * ) Notice: Subject to any disclaimer, the term of this patent is extended or adjusted under 35 U.S.C. 154(b) by 94 days.

(21) Appl. No.: 10/030,408

(22) PCT Filed: Jun. 30, 2000

(86) PCT No.: PCT/AU00/00781

§ 371 (c)(1),
(2), (4) Date: Jan. 3, 2002

(87) PCT Pub. No.: WO01/03865

PCT Pub. Date: Jan. 18, 2001

(30) Foreign Application Priority Data

Jul. 7, 1999 (AU) ..... PQ1493

(51) Int. Cl.[7] ..... F16L 9/00; B21D 39/00

(52) U.S. Cl. ..... 138/166; 138/156; 138/167; 138/168; 29/513; 29/521

(58) Field of Search ..... 138/166, 156, 138/167, 168; 29/21.1, 513, 521, 557, 558; 83/54; 72/51

(56) References Cited

U.S. PATENT DOCUMENTS

| | | | | | |
|---|---|---|---|---|---|
| 518,767 | A | * | 4/1894 | Plecker | 29/513 |
| 3,129,489 | A | * | 4/1964 | Nelson | 29/21.1 |
| 3,728,881 | A | * | 4/1973 | Coop | 72/52 |
| 3,824,757 | A | * | 7/1974 | Coop | 138/166 |
| 4,490,422 | A | * | 12/1984 | Pascher | 428/35.1 |
| 4,734,971 | A | * | 4/1988 | Dupasquier | 29/417 |
| 5,357,667 | A | | 10/1994 | Schutz | 29/509 |

FOREIGN PATENT DOCUMENTS

| | | |
|---|---|---|
| DE | 197 49 728 A1 | 4/1997 |
| EP | 0 715 910 A1 | 11/1995 |

* cited by examiner

*Primary Examiner*—Patrick Brinson
(74) *Attorney, Agent, or Firm*—McGuireWoods LLP

(57) ABSTRACT

A method of forming a tube involves the punching of tabs from overlapping longitudinal seam and folding the tabs to mechanically fix the opposed lateral edges of the sheet material forming the tube.

6 Claims, 1 Drawing Sheet

METHOD OF FORMING A TUBE

TECHNICAL FIELD

This invention relates to a method of forming a tube.

BACKGROUND ART

It is known to form a tube by taking an elongate sheet of material having a pair of spaced, parallel lateral edges and bending the material about a longitudinal axis so that the lateral edges abut or overlap so as to form a tube. Thereafter, the abutting or overlapping lateral edges are fixed together, usually by welding, riveting or the like.

The present invention relates to a novel method of fixing together overlapping lateral edges during formation of a tube, and to a tube thus formed.

DISCLOSURE OF INVENTION

According to one aspect the invention resides in a method of forming a tube from an elongate sheet of material having a pair of spaced and parallel edges, the method including:— forming the elongate sheet into a tube such that the lateral edges of the sheet overlap to define an overlap region having an inner overlap portion and an outer overlap portion;

punching the inner overlap portion and outer overlap portion to define a tab in each, said tabs being aligned such that the tab defined in the inner portion is directly underneath the tab defined in the outer portion; and folding the tabs whereby the inner overlap portion and outer overlap portion are fixed together.

According to another aspect, the invention resides in a tube formed according to the method defined above.

According to another aspect the invention resides in a tube manufactured from an elongate sheet of material formed into a tube and having its lateral edges overlapping to define an inner overlapping portion and an outer overlapping portion, a tab defined in the inner overlapping portion, a tab defined in the outer overlapping portion, said tabs being aligned such that the tab defined in the inner overlapping portion lies directly beneath the tab defined in the outer overlapping portion, said tabs being folded such that the inner overlapping portion and outer overlapping portion are fixed together.

According to another aspect the invention resides in a tube or the like including:— a longitudinally extending seam formed by overlapping opposed edges of sheet material forming the tube; and fastening means for fastening together the overlapped edges, the fastening means being integrally formed by material punched from the overlapped edges.

According to another aspect the invention resides in a method of forming a tube or the like, the method including:— bending sheet material about a longitudinal axis to overlap opposed edges of the material;

integrally fastening the overlapped edges by punching material from the overlapped edges.

BRIEF DESCRIPTION OF DRAWINGS

Reference will now be made to the accompanying Figures which illustrate preferred embodiment(s) of the invention and in which:—

BEST MODE

Figure 1:
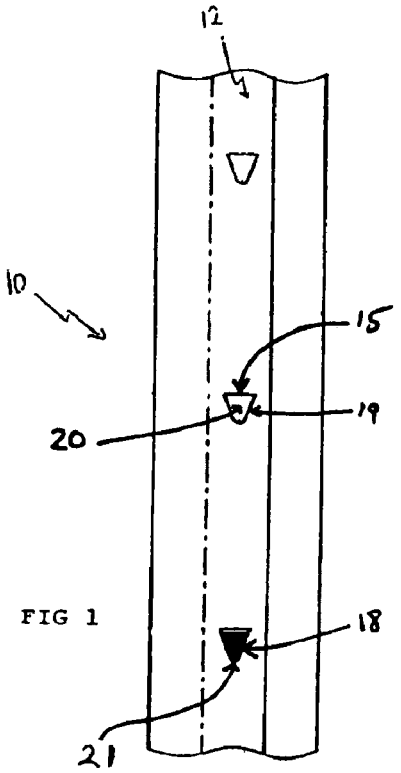
FIG. 1 is front elevation of a tube according to the invention.

With reference to FIG. 1, there is shown a tube 10 formed from a sheet of material bent about a longitudinal axis such that the opposed lateral edges of the sheet of material overlap to define an overlapping region 12 whereat an outer overlapping portion 14 overlies an inner overlapping portion 16.

Figure 3:
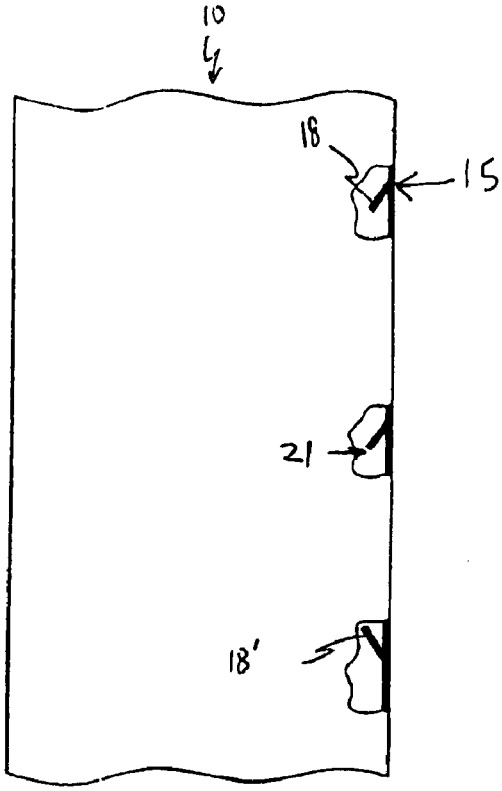
FIG. 3 is a side elevation with cutaway detail of the tube of FIG. 1.
Figure 2:
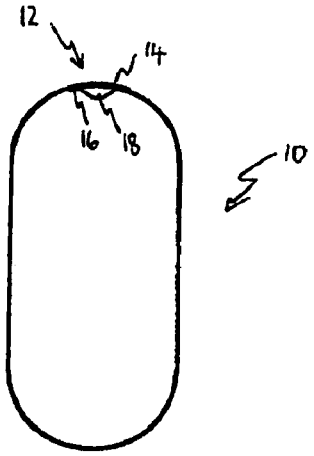
FIG. 2 is an underside plan of the tube of FIG. 1.
Figure 1A:
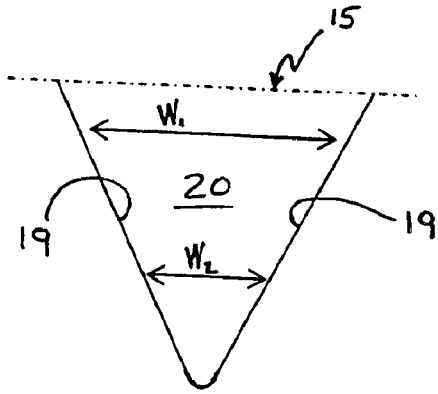
FIG. 1A is a blow-up of one of the tab cut-out regions 20 shown in FIG. 1.

U or V shaped tabs 18 are punched from the inner and outer overlapping portions and thereafter bent inwardly together, about a fold axis 15 to the position illustrated by 18' in FIG. 3, thereby mechanically fixing the inner and outer overlapping portions together. The fold axis 15 is schematically illustrated in dashed lines in the blow-up of the tab cut-out region 20 shown in FIG. 1A. Fold axis 15 extends transverse to the longitudinal axis of the elongate sheet 12 at a fold portion of the tab 18 that remains in the plane of the sheet 12. The tab 18 reduces in dimension in a direction parallel to the fold axis 15 between the fold portion and the free end 21 of the tab 18, as shown best in FIG. 11A where $w_1$ and $w_2$ represent the width of the tab, at longitudinally spaced positions parallel to the fold axis 15. Beginning at the fold axis 15 and progressing toward the free end, $w_1$ is greater than $w_2$ because the free end 21 has a smaller width than the fold axis 15. Thus, FIG. 1 shows that that the tab 18 reduces in dimension as one moves parallel to the fold axis 15 from the fold portion to the free end 21.

As shown in the Figures, the folded tabs 18 are formed by punching triangular-shaped cut-outs 20, defined by inwardly sloping shoulders 19 of the inner and outer overlapping portions of the sheet. The interaction of the V or V-shaped tab 18 with tapered shoulders 19 mechanically fix the inner and outer overlapping portions together, thereby preventing them from translating relative to each other.

It will be understood that both the outer overlapping portion and inner overlapping portion are punched such that the tabs defined in the inner and outer portions abut each other and are bent in unison to the final interlocking position shown at 18' in FIG. 3.

As shown, the punching and bending operation is repeated at regular intervals along the longitudinal length of the tube such that the overlapping seam is stabilized along its entire length. The tabs may be simultaneously punched.

It will, of course, be realised that the above has been given by way of illustrative example of the invention. Any variations, modifications, or omissions, as would be apparent to persons skilled in the art, are deemed to fail within the broad scope of this invention.

What is claimed is:

1. A method of forming a tube from an elongate sheet of material having a pair of lateral edges, said method comprising the steps of:

forming the elongate sheet into a tube such that the lateral edges of the sheet overlap to define an overlap region having an inner overlap portion and an outer overlap portion;

punching the inner overlap portion and outer overlap portion of the tube to define a tab in each, each tab including a fold portion and a free end extending away from the fold portion, said tabs being aligned such that the tab defined in the inner overlap portion is directly underneath the tab defined in the outer overlap portion; and folding the tabs at the fold portions about a fold axis whereby the inner overlap portion and outer overlap portion are fixed together, wherein the tab reduces in dimension parallel to the fold axis between the fold portion and free end such that the folded tabs cannot translate relative to each other in a direction orthogonal to the fold axis and parallel to the inner and outer overlap portions.

2. The method as claimed in claim 1, wherein the tabs are folded inwardly.

3. The method as claimed in claim 1, wherein the tabs are substantially V or U shaped.

4. The method as claimed in claim 1, wherein the tabs are simultaneously punched.

5. The method as claimed in claim 1, wherein complementary pairs of tabs are provided along the length of the tube at regular intervals.

6. The tube formed according to the method defined in any one of claims 1 to 5.

* * * * *